US005966153A

United States Patent [19]

Mitani et al.

[11] Patent Number: 5,966,153

[45] Date of Patent: Oct. 12, 1999

[54] INK JET PRINTING DEVICE

[75] Inventors: Masao Mitani; Kenji Yamada; Katsunori Kawasumi; Osamu Machida; Kazuo Shimizu, all of Hitachinaka, Japan

[73] Assignee: Hitachi Koki Co., Ltd., Tokyo, Japan

[21] Appl. No.: 08/771,912

[22] Filed: Dec. 23, 1996

[30] Foreign Application Priority Data

Dec. 27, 1995 [JP] Japan ..... P7-340486

[51] Int. Cl.[6] ..... B41J 2/05

[52] U.S. Cl. ..... 347/62; 347/204

[58] Field of Search ..... 347/62, 204

[56] References Cited

U.S. PATENT DOCUMENTS

| | | | |
|---|---|---|---|
| 3,747,120 | 7/1973 | Stemme | 347/70 |
| 4,105,892 | 8/1978 | Tashiro | 347/204 |

(List continued on next page.)

FOREIGN PATENT DOCUMENTS

| | | | |
|---|---|---|---|
| 0 446 918 A2 | 9/1991 | European Pat. Off. . | |
| 0 583 474 A1 | 2/1994 | European Pat. Off. . | |
| 0 594 369 A2 | 4/1994 | European Pat. Off. . | |
| 0 438 295 A1 | 7/1997 | European Pat. Off. . | |
| 2 126 182 | 12/1971 | Germany . | |
| 32 24 081 A1 | 1/1983 | Germany . | |
| 37 17 294 A1 | 12/1987 | Germany . | |
| 43 17 944 A1 | 12/1993 | Germany . | |
| 195 05 465 A1 | 8/1995 | Germany . | |
| 48-9622 | 2/1973 | Japan | B41J 3/04 |
| 53-11037 | 2/1978 | Japan . | |
| 53-110374 | 9/1978 | Japan . | |
| 53-45698 | 12/1978 | Japan . | |
| 54-39529 | 3/1979 | Japan . | |
| 54-51837 | 4/1979 | Japan | B41J 3/04 |
| 54-59936 | 5/1979 | Japan . | |
| 57-61582 | 4/1982 | Japan . | |
| 58-84401 | 5/1983 | Japan . | |
| 59-199256 | 11/1984 | Japan . | |
| 61-49860 | 3/1986 | Japan . | |
| 62-152860 | 7/1987 | Japan . | |
| 62-167056 | 7/1987 | Japan . | |
| 62-240558 | 10/1987 | Japan . | |
| 1-190459 | 7/1989 | Japan . | |
| 3-246055 | 11/1991 | Japan . | |
| 6-71888 | 3/1994 | Japan | B41J 2/05 |
| WO 90/13428 | 11/1990 | WIPO . | |

OTHER PUBLICATIONS

L.S. Chang, et al. "Overcoat Failure Mechanisms in Thermal Ink Jet Devices", Proceedings of the 9th International Congress on Advancements in Non–Impact Printing Technology from Japan Hardcopy, '93—pp. 241–244.

Ronald A. Askeland, et al. "the Second–Generation Thermal InkJet Structure", Hewlett–Packard Journal, Aug. 1988, pp. 28–31.

Nikkei Mechanical, Dec. 28, 1992—pp. 58–62 (Discussed on P. 1 of the present application).

Herausgegeben von, et al., "Lexikon Electronik Und Mikroelektronik", VDI Verlag, Apr. 22, 1994, pp. 999–1000.

J.S. Aden, et al., "The Third–Generation HP Thermal InkJet Printhead," Hewlett–Packard Journal, Feb., 1994, pp. 41–45.

(List continued on next page.)

*Primary Examiner*—Joseph Hartary

*Attorney, Agent, or Firm*—Whitham, Curtis & Whitham

[57] ABSTRACT

An ink jet printing device including an ink channel wall defining an ink chamber; a nozzle portion formed with a nozzle connecting the ink chamber with atmosphere; and a thermal heater formed to the ink channel wall adjacent to the nozzle portion, the thermal heater including a Ta—Si—O ternary alloy thin film resistor having a composition of 64% ≦Ta≦85%, 5%≦Si≦26%, and 6%≦O≦15% and a nickel film conductor.

6 Claims, 8 Drawing Sheets

U.S. PATENT DOCUMENTS

| | | | |
|---|---|---|---|
| 4,313,124 | 1/1982 | Hara | 347/57 |
| 4,339,762 | 7/1982 | Shirato et al. . | |
| 4,345,262 | 8/1982 | Shirato | 347/56 X |
| 4,429,321 | 1/1984 | Matsumoto | 347/59 |
| 4,460,494 | 7/1984 | Abe et al. . | |
| 4,517,444 | 5/1985 | Kawahito et al. . | |
| 4,532,530 | 7/1985 | Hawkins . | |
| 4,535,343 | 8/1985 | Wright et al. . | |
| 4,663,640 | 5/1987 | Ikeda | 347/63 |
| 4,719,478 | 1/1988 | Tachihara et al. . | |
| 4,772,520 | 9/1988 | Takeno | 347/204 |
| 4,777,583 | 10/1988 | Minami | 347/202 X |
| 4,914,562 | 4/1990 | Abe | 347/62 X |
| 4,931,813 | 6/1990 | Pan et al. . | |
| 4,951,063 | 8/1990 | Hawkins et al. . | |
| 5,053,787 | 10/1991 | Teresawa et al. . | |
| 5,113,203 | 5/1992 | Takagi et al. . | |
| 5,142,308 | 8/1992 | Hasegawa et al. . | |
| 5,206,659 | 4/1993 | Sakurai et al. . | |
| 5,444,475 | 8/1995 | Mitani . | |
| 5,666,140 | 9/1997 | Mitani | 347/62 X |
| 5,710,583 | 1/1998 | Mitani | 347/62 |
| 5,790,154 | 8/1998 | Mitani | 347/59 |

OTHER PUBLICATIONS

R.A. Askeland et al., "The Second–Generation Thremal InkJet Structure," Hewlett–Packard Journal, Aug., 1998, pp. 28–31.

Collection of Presentations from the 27$^{th}$ Japan Thermal Transmission Symposium, May, 1990, pp. 334–336.

Patent Abstracts of Japan, 05297005, Nov. 26, 1993, "Manufacture of Heating Resistor for Ink Jet Printer."

Official Action of the German Patent Office, File No.: P 43 17 994.4–27, of Hitachi Koki Co., Ltd. dtd Sep. 14, 1994 with English translation.

Keil, Merl and Vinaricky, "Elektrische Kontakte und irhe Werkstoffe,"pp. 245–247, dtd 1984.

Patent Abstracts of Japan, M–589, May 20, 1978, vol. 11, No. 15, 61–284450, "Liquid Jet Recording Head and Apparatus."

Patent Abstracts of Japan, M–218, May 28, 1983, vol. 20, No. 124,58–42466, "Liquid Jet Recording Method."

Hewlett–Packard Journal, Aug. 1988, "Design and Development of a Color Thermal Inkjet Print Cartridge," Jeffrey P. Baker, et al.

INK JET PRINTING DEVICE

BACKGROUND OF THE INVENTION

1. Field of the Invention

The present invention relates to an ink jet printing device using thermal energy to eject ink droplets toward a recording medium.

2. Description of the Related Art

Japanese Laid-Open Patent Application (hereinafter referred to as "OPI Publication") Nos. SHO-48-9622 and SHO-54-51837 disclose ink jet printing devices which apply a thermal pulse to ink filling an orifice to rapidly vaporize a portion of the ink. The energy generated by expansion of the vaporized ink is used to eject an ink droplet from the orifice.

OPI Publication Nos. SHO-48-9622 and SHO-54-51837 describe an ink jet recording device wherein a portion of ink in an ink chamber is rapidly vaporized to form an expanding bubble. The expansion of the bubble ejects an ink droplet from an orifice connected with the ink chamber. As described in the August 1988 edition of Hewlett Packard Journal and the Dec. 28, 1992 edition of Nikkei Mechanical (see page 58), the simplest method for rapidly heating the portion of the ink is by applying an energizing pulse of voltage to a heater. Heaters described in the above-noted documents are constructed from a thin-film resistor and thin-film conductors covered with an anti-corrosion layer for protecting the resistor from corrosion damage. The anti-corrosion layer is additionally covered with one or two anti-cavitation layers for protecting the anti-corrosion layer against cavitation damage.

OPI Publication NO. HEI-6-71888 describes a protection-layerless heater formed from a Cr—Si—SiO or Ta—Si—SiO alloy thin-film resistor and nickel conductors. Absence of protection layers from the heater greatly improves efficiency of heat transmission from the heater to the ink. This allows great increases in print speed, i.e., in frequency at which ink droplets can be ejected.

SUMMARY OF THE INVENTION

Tests were performed on a print head including the thermal heater of OPI Publication No. HEI-6-71888. Upon testing different heads using a variety of water-based inks to print in full colors, some of the print heads were observed to have a shorter life than others. Further investigation revealed that the water-based ink ejected from those heads having a sufficiently long life was neutral and had a large resistivity. On the other hand, those heads used to eject ink having pH of between 8 and 9 and a small resistivity of $10^2$ to $10^3$ Ω cm had an insufficiently short life. It is apparent that in those head with an insufficiently short life, the thin film heaters used to heat the ink for ejecting droplets were destroyed by galvanization.

To overcome this problem, the present inventors proposed a method in U.S. patent application Ser. No. 08/580,273 filed on Dec. 27, 1995. In this method a thin oxidation film having excellent electric insulation properties is formed on a Ta—Si—SiO alloy thin film heater by subjecting the heater to oxidation processes at high temperatures. Such an oxidation film would completely prevent the thin film heater from being destroyed by galvanization even in strongly electrolytic, non-neutral ink.

It is desirable to provide a print head with even higher thermal efficiency and formed with a composition to provide the necessary characteristics required for a thin film heater of a thermal ink jet print head.

In order to achieve this objective, an ink jet printing device according to the present invention includes an ink channel wall defining an ink chamber; a nozzle portion formed with a nozzle connecting the ink chamber with atmosphere; and a thermal heater formed to the ink channel wall adjacent to the nozzle portion, the thermal heater including a Ta—Si—O ternary alloy thin film resistor having a composition of 64%≦Ta≦85%, 5% ≦Si ≦26%, and 6% ≦O≦15% and a nickel film conductor.

According to another aspect of the present invention, a method for forming a thermal heater of an ink jet printing device includes the steps of: adjusting a target to a predetermined surface area ratio of Ta to Si; placing the target in confrontation with a silicon substrate in a vacuum chamber; exhausting the vacuum chamber; introducing a gas including a predetermined amount of oxygen into the vacuum chamber; energizing the target; forming on the silicon substrate a Ta Si—O ternary alloy thin film resistor having a composition 64%≦Ta≦85%, 5%≦Si≦26%, and 6%≦O≦15%; and forming a nickel thin film conductor on a portion of the resister.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
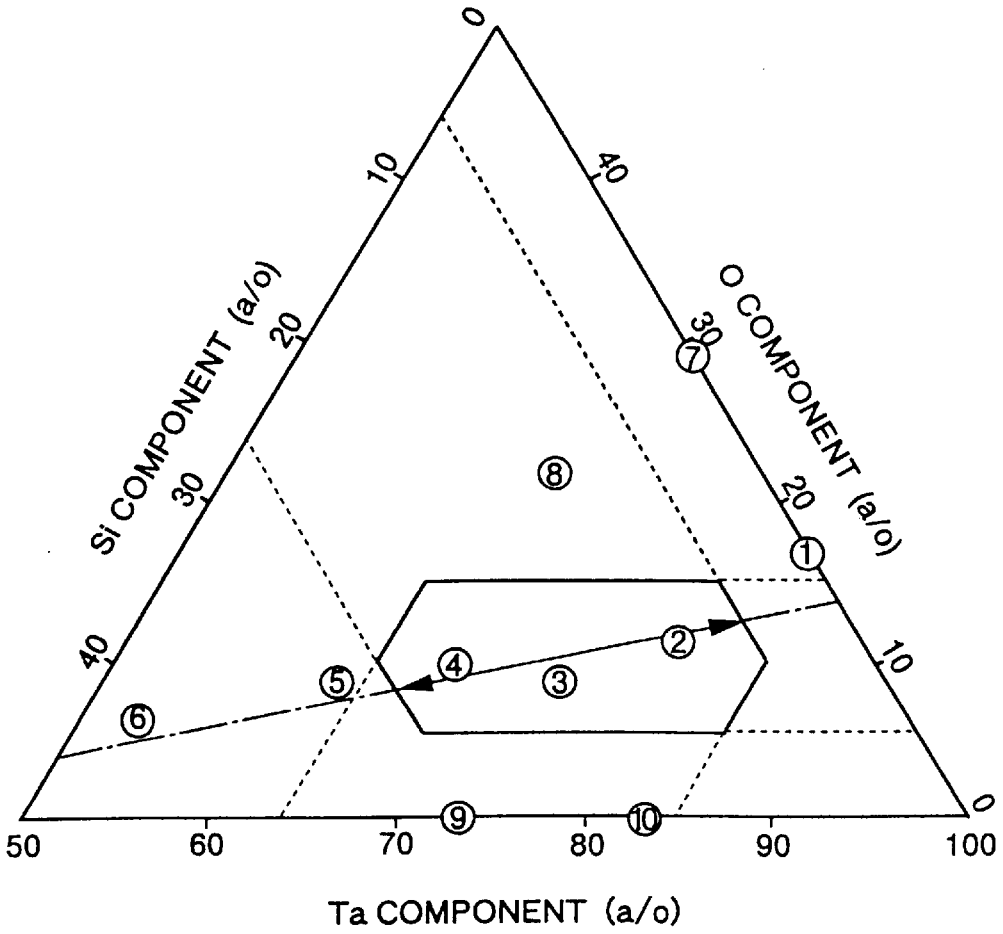
FIG. 1 is a graph representing composition of ten samples of Ta—Si—O ternary alloy thin films tested by the present inventors.

An ink jet printing device according to a preferred embodiment of the present invention will be described while referring to the accompanying drawings wherein like parts and components are designated by the same reference numerals to avoid duplicating description.

First, an explanation will be provided for a method of producing a thermal heater according to the present invention and for a desirable compositional range of a Ta—Si—O ternary alloy thin film, referred to as a Ta—Si—O thin film hereinafter, of the thermal heater.

The Ta—Si—O thin film was formed on a substrate placed in a DC sputter device wherein a high voltage is applied in a low pressure argon atmosphere, whereupon the argon atoms ionize. By applying an electric field, the argon ions are accelerated and collide with the target. Atoms are small clumps of the target are blown off the target and onto the substrate. A sputter devices is called a DC sputter when the applied voltage is a direct current and an AC sputter device when the applied voltage is an alternate current. AC sputter devices are used when the target is an insulating material. The Ta—Si—O thin film only formed on the substrate was used as a sample during measurements taken to determine the compositional ratio, the resistivity, the thermal oxidation characteristic, and the like of the Ta—Si—O thin film.

Next, a nickel thin film was formed to an approximately 1 $\mu$ thickness on the Ta—Si—O thin film using fast sputter techniques in the same DC sputter device. The resultant product was photoetched to a predetermined shape to from a thermal heater. The resultant thermal heater was used for step-up stress tests (SST) and pulse energizing tests.

The following is a more detailed explanation of how the

Ta—Si—O thin film was formed. A target adjusted to a predetermined surface area ratio of Ta to Si, for example, with surface area of Ta to the surface area of Si adjusted to a ratio of 70 to 30, was placed in confrontation with a thermally oxidized silicon substrate in a vacuum chamber of the DC sputter device. The vacuum chamber was then exhausted to a vacuum of $5\times10^{-7}$ Torr or less. Afterward, argon gas including a predetermined amount of oxygen was introduced into the vacuum chamber until the partial pressure of argon gas was 1 to 30 mTorr and the partial pressure of oxygen gas was $1\times10^{-4}$ to 1 mTorr. The target was then energized with a voltage of 400 V to 10,000 V to induce glow discharge. A Ta—Si—O thin film having a predetermined composition was formed to a thickness of approximately 1,000 Å by reactive sputtering on the silicon substrate. In reactive sputtering, a gas, such as nitrogen or, as in the present example, oxygen, that easily reacts in a low pressure argon atmosphere is mixed with the argon gas. The ionized gas accumulates on the substrate while reacting with the atoms and the like which are blown off the target and which are in an easily reactive state. The silicon substrate was rotated while generating the Ta—Si—O thin film. However, no particular heating was performed other than baking the silicon substrate.

Although tests were carried on a variety of samples having a broad range of the Ta—Si—O composition, the following explanation will be provided for ten representative types of Ta—Si—O thin film indicated as sample 1 to 10 in Table 1. The compositional ratio of samples 1 to 10 was determined by chemical analysis and a scanning Auger Electron Spectroscopy.

Samples 1 to 10 were produced using the above-described production method. Different composition ratios of Ta, Si, and O were obtained by changing the oxygen partial pressure and the surface area ratio of Ta to Si in the target.

TABLE 1

| | In Atomic Percents | | |
|---|---|---|---|
| | Ta | Si | O |
| 1 | 83 | 0 | 17 |
| 2 | 79 | 10 | 11 |
| 3 | 74 | 17 | 9 |
| 4 | 68 | 22 | 10 |
| 5 | 63 | 28 | 9 |
| 6 | 53 | 41 | 6 |
| 7 | 71 | 0 | 29 |
| 8 | 67 | 11 | 22 |
| 9 | 73 | 27 | 0 |
| 10 | 83 | 17 | 0 |

FIG. 1 graphically represents the ten samples of Table 1 in a manner generally used in metallurgy for indicating the compositional ratio in ternary alloys. As indicated in FIG. 1, as will be understood from the following explanation, compositional ratio of $64\% \leqq Ta \leqq 85\%$, $5\% \leqq Si \leqq 26\%$, and $6\% \leqq O \leqq 15\%$, which includes samples 2 to 4, is most suitable for the thin film resistor of a thermal heater.

The compositional ratios of samples 1 to 6 are substantially linear in FIG. 1. Samples 7, 8, 9, and 10 were provided to demonstrate how variation in composition above and below this line affects the characteristics of resultant thermal heaters. It should be noted that the horizontal of graphs in FIGS. 2, 5, 6, 8, and 10 have been set to correspond to the linear relationship of samples 1 to 6 to facilitate comparison.

Next, an explanation will be provided for the basic characteristics of the Ta—Si—O thin film.

Figure 2:
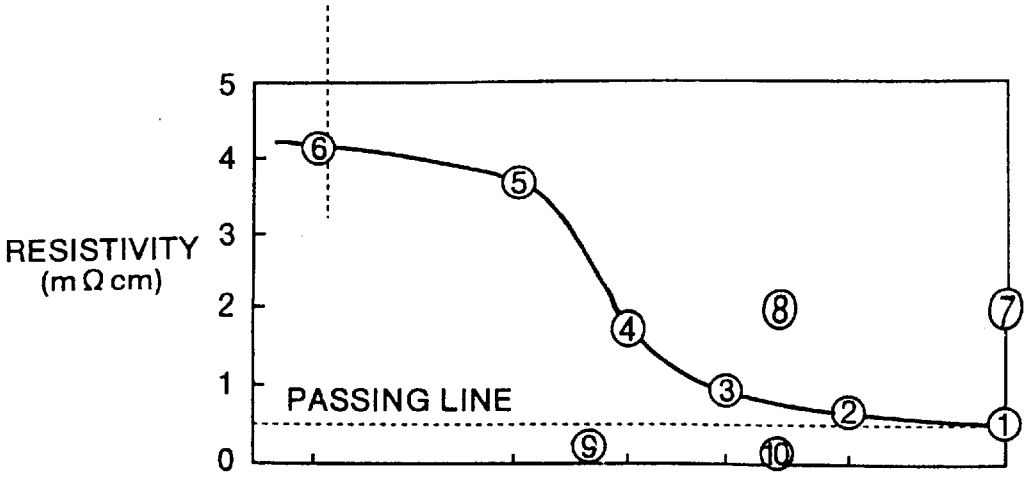
FIG. 2 is a chart indicating resistivity of the ten samples.

FIG. 2 indicates the resistivity of the ten types of the Ta—Si—O thin film. Samples 1 to 8 have a resistivity greater than 0.5 m Ω cm, which is the lower limit of the resistivity usable in a thermal heater. However, samples 9 and 10 have small resistivity of 0.2 m Ω cm. In order to produce a thermal heater with a resistivity of about 100 Ω using samples 9 and 10, the Ta—Si—O thin film would need to be formed to a thickness of about 200 Å, which makes samples 9 and 10 impractical. Therefore, samples 9 and 10 will be omitted from further discussion.

Figure 3:
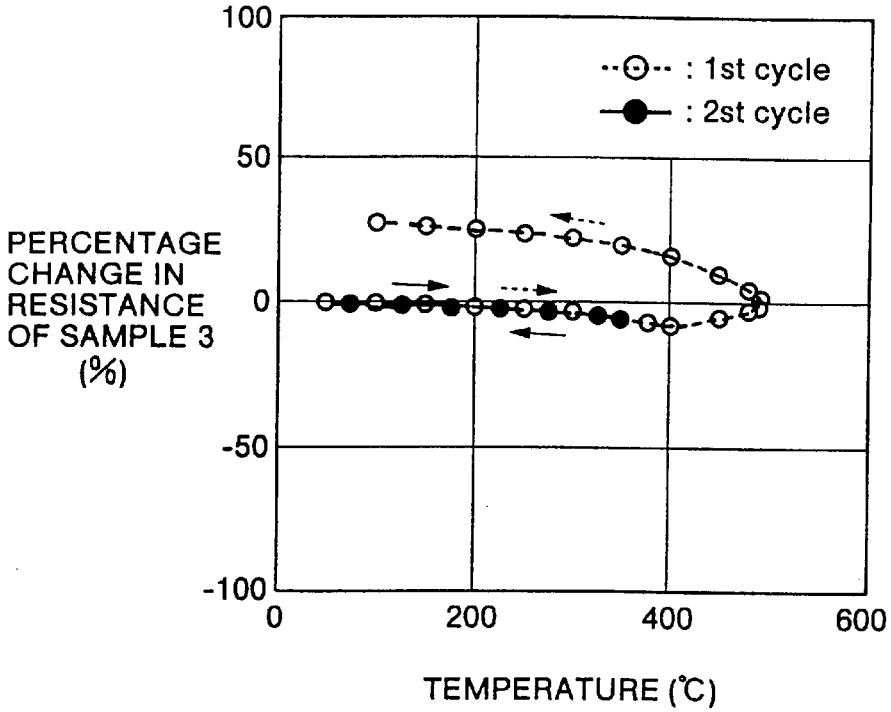
FIG. 3 is a graph representing changes in resistance of sample 3 during heat treatment.
Figure 4:
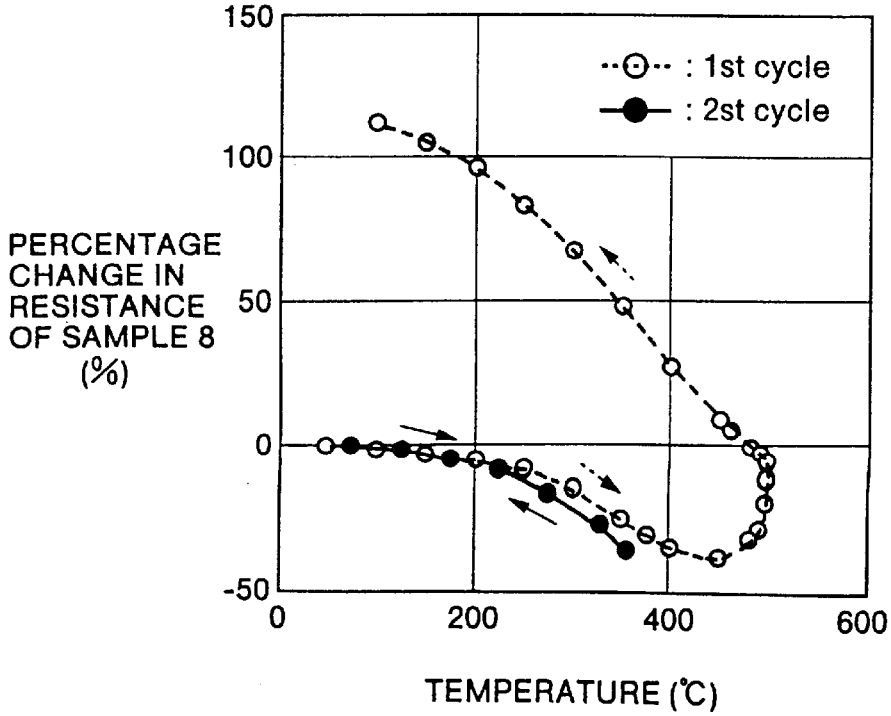
FIG. 4 is a graph representing changes in resistance of sample 8 during heat treatment.

FIG. 3 and FIG. 4 show examples of change in resistance value undergone by the Ta—Si—O thin films of samples 3 and 8 respectively when thermally oxidized in atmosphere. The Ta—Si—O thin films of sample 3 and sample 8 were heated at a speed of 10° C./min. in atmosphere up to a maximum temperature of 500° C. The maximum temperature of 500° C. was maintained for ten minutes, whereupon the samples 3 and 8 were cooled at a speed of 10° C./min. The values shown in FIGS. 3 and 4 indicate the percent change in resistance observed during cooling and calculated using the following formula:

$$\frac{R_T - R_O}{R_O} \times 100 \quad (1)$$

wherein $R_t$ is the resistance value at temperature T in degrees centigrade; and $R_o$ is the initial resistance at room temperature.

This thermal oxidation process oxidized the surface of the Ta—Si—O thin films to a depth of about 100 Å and changed to defect-free insulative layers. It has been confirmed by a variety of methods that the volume of this portion increases approximately 200 Å and becomes more dense and uniform. The thin films of all samples thermally oxidized in this manner are extremely stable with respect to further heating to 500° C. or less.

Figure 5:
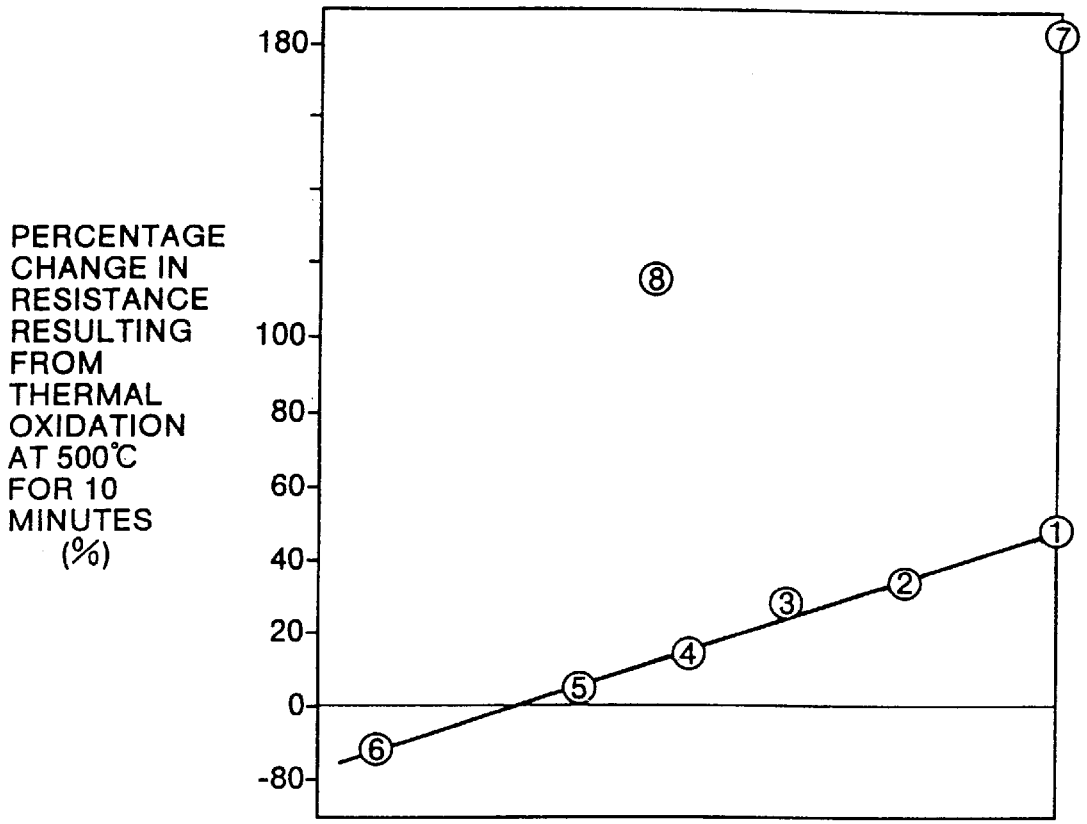
FIG. 5 is a chart indicating percentage change in resistance produced by heat treating samples 1 to 8.

FIG. 5 shows changes in resistance value of samples 1 to 8 when thermally oxidized under the above-described conditions and then cooled to room temperature. Samples 7 and 8 develop a wide range of different resistance values when subjected to the thermal oxidation process. This makes these materials difficult to apply in a thermal heater.

Figure 6:
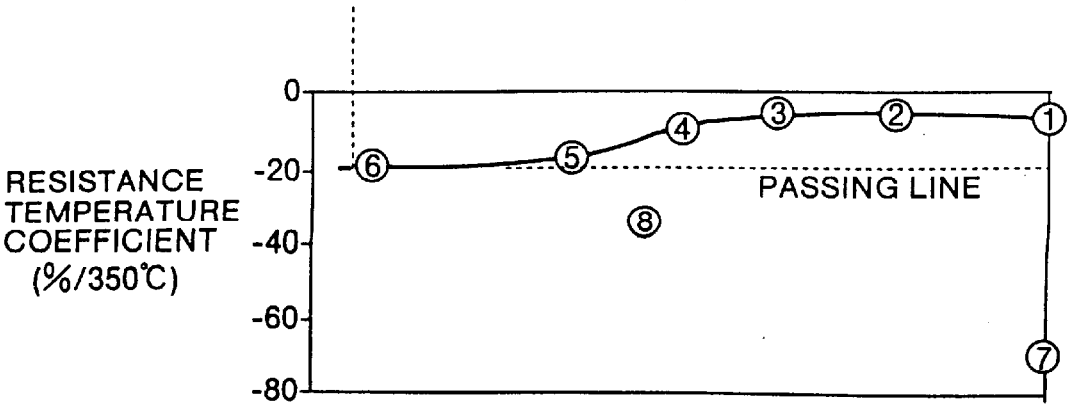
FIG. 6 is a chart indicating a resistance temperature coefficient of samples 1 to 8 determined by thermal oxidation treatment.

As can be seen in FIGS. 3 and 4, the Ta—Si—O thin films of samples 3 and 8 have a negative resistance temperature coefficient up until 350° C. When this coefficient is negative, then in ink jet devices using a constant voltage drive method, the resistant value of the thermal heater drops in accordance with rise in temperature of the thermal heater. As a result, the power applied to the thermal heater automatically increases. Accordingly, thermal heaters with large negative coefficients require more and more power to drive as temperature increase and so have low reliability. Accordingly, as shown in FIG. 6, samples 7 and 8 are not as appropriate for use as thermal heaters as one the other samples 1 to 6, which have higher resistance coefficients. Although, the coefficient of samples5 and 6 are in the range of −14% to −18%. They can still be considered as candidates. However, samples 7 and 8 will be omitted from further explanation because they are inappropriate for producing thermal heaters.

Next, an explanation will be provided for the characteristics of thermal heaters formed with the compositions of samples 1 to 6 when applied with voltage pulses in atmosphere.

Each thermal heater was formed by first thermally oxidizing a silicon substrate to form on its upper surface an approximately 2 $\mu$m thick layer of $SiO_2$. On top of the silicon substrate was formed in sequence a Ta—Si—O thin film and a nickel thin film. The resultant product was photoetched to produce a thermal heater having a surface area of 50 $\mu$m.

To form an insulative oxidized film on the surface of each thermal heater, each thermal heater was thermally processed under conditions to be referred to as the standard thermal process conditions hereinafter. The Ta—Si—O thin film was heated only to between 500 and 600° C. in atmospheres by applying 1.5 W×100 $\mu$sec pulses of power at a frequency of 5 KHz to each thermal heater for 60 seconds. Very little change in resistance, that is within ±3%, was observed during the pulse thermal oxidation process.

The breakdown voltage of the thermally oxidized film is near the bulk value and can be estimated as up to 10 V/100 Å. Because the actual operating voltage applied to the thermal heater is between 15 and 20 V, the thermally oxidized thin film needs to be capable of insulating against only a few volts when used in electrolytic ink. In other words, the oxidized insulation film needs to have a thickness of a only few 10 Å. The thin film is thermally oxidized using pulses of energy to avoid oxidizing the nickel in the thin film conductor and also to avoid adverse effects to the driver circuit, which in the present device is formed on the same silicon layer as the thermal heater.

Unless otherwise mentioned, the thermal heaters described below will be considered as having been subjected to pulse thermal oxidation processes.

Thermal heaters including Ta—Si—O thin films and nickel thin films were immersed in a water-based yellow ink and applied with pulses of energy. Stroboscopic photography was used to observe bubbles generated on the thermal heaters and determine the energizing power required to start nucleation boiling. It was determined that an energizing power of 2.7 W×1 $\mu$sec was required. Standard pulse application conditions were set to an energizing power increased by approximately 10% to an excessive power of 3.0 W×1 $\mu$sec and applied in pulses at a frequency of 10 kHz.

During pulse energizing, the temperature of the thermal heaters rose at a speed of $3\times10^{8}$° C./sec and reached around 300 to 330° C. Boiling achieved by thermal heaters when merely submerged is called open pool boiling. However, in print heads, thermal heaters are surrounded by walls and ceilings. Boiling is called closed pool boiling under these conditions.

The resistance of samples 1 to 6 changed only within 2 to 3% even after the thermal heaters were consecutively applied with a hundred million pulses under the standard pulse application conditions. Therefore, samples 1 to 6 show excellent anti-pulse and anti-oxidation characteristics.

Next, an explanation will be provided for evaluation of the thermal heaters during step-up stress tests and anti-galvanization tests performed in water-based ink.

First, the anti-galvanization characteristics only of the thermal heaters were evaluated using the following test. The energizing power only of the standard pulse application conditions was lowered to 2.5 W and tests were performed by consecutively applying pulses of voltage to the thermal heaters in water-based ink. The voltage applied was only 91% of actual driving voltage and insufficient for generating vapor bubbles. However, this is a sufficient voltage for determining susceptibility of samples to galvanization.

Neither nucleation boiling nor cavitation damage occurred under these voltage application conditions. The samples 1 to 6 all successfully withstood application of one hundred million pulses during the non-bubble generating test without showing change in resistance values. That is to say, the insulation thermal oxidation film totally protected the Ta—Si—O thin films from galvanization.

The positive electrode formed from a naked, non-protected nickel film showed some galvanization, although not enough to affect the conductivity. The positive electrode will be protected from the galvanization if the positive electrode formed from the nickel thin film is covered by a heat resistant wall, for example, using the method described in U.S. patent application Ser. No. 08/502,179 filed by the present inventors on Jul. 13, 1995 now U.S. Pat. No. 5,697,144.

The method described therein is for fabricating an ink ejection head including a frame 17 having a predetermined ink supply channel 16; and a head chip mounted on the frame 17. The head chip is made from a silicon substrate 1. A plurality of heaters, each made from thin-film conductors 4 and a thin-film resistor 3, are formed on a first surface of the silicon substrate. A drive LSI 4 is formed on the silicon substrate 1 and connected to each heater with a corresponding conductor 4 for applying pulses of energy to a corresponding heater to generate heat at a surface of the corresponding heater. An orifice 11 plate formed with nozzles 12 is provided. Each nozzle 12 extends parallel or perpendicular to the surface of a corresponding heater so that bubbles generated by heat at the surface of each heater ejects ink droplets 13 through the nozzles 12. A plurality of individual ink channels 9 are provided on the silicon substrate 1 in correspondence with each of the nozzles. A common ink channel is provided on the silicon substrate and connects all the individual ink channels 9. A single ink channel 14 is provided in the silicon substrate 1 and connects with the entire length of the common ink channel 10. At least one through-hole is formed through a second surface SS of the silicon substrate 1, which is opposite the first channel 14 to the first surface FS.

The ink ejection head with this configuration can be formed using the following method. First, the drive LSI 2 is formed on the first surface FS of the silicon wafer. Next, the thin-film resistors 3 and the thin-film conductors 4 are formed on the first surface FS of the silicon wafer. Afterward, a polyimide partition wall 8 is formed with ink channels 9, 10 on the first surface FS of the silicon wafer. Then, the ink channels 15 and the through-hole are formed by silicon anisotropic etching from both the first side and the second side of the silicon wafer. The orifice plate 11 is connected to the first surface FS of the silicon wafer. The nozzles 12 are then formed in the orifice plate 11 using photoetching. After cutting silicon wafer into the head chips, the head chips are assembled on the frame 17 and mounting wiring 7 using die bonding techniques.

The ability of the thermal heaters to withstand excessive weight load in ink was tested and evaluated using a step up stress test. The SST evaluations were performed in an open pool of water-based ink that was 300 μm deep. The thermal heaters were applied with 1 μsec pulses of voltage at a frequency of 2 kHz. Load was increased one step with every application of $10^4$ pulses. The application power was increased and the resistance value measured with each step until the thermal heater was destroyed. The application voltage was increased in steps of 0.2 W/step.

Figure 7:
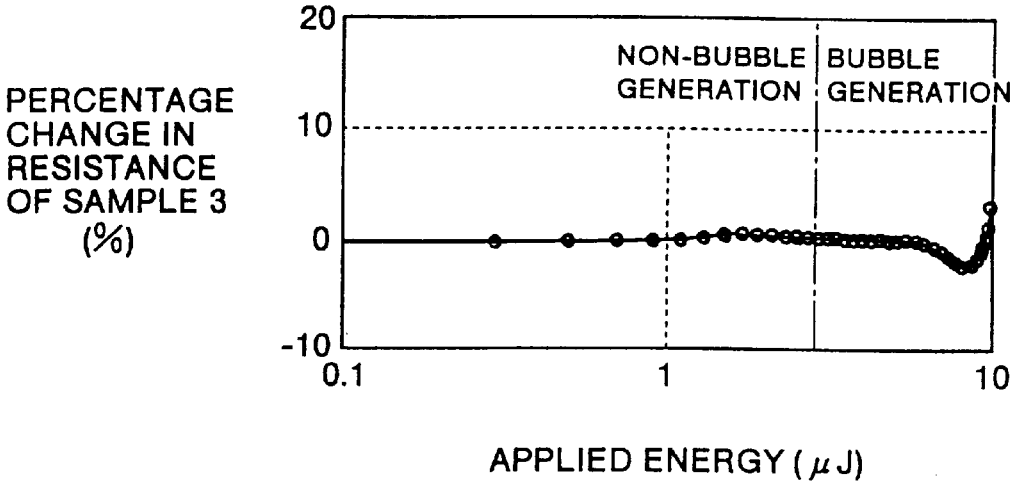
FIG. 7 is a graph representing step stress test characteristic of sample 3.
Figure 8:
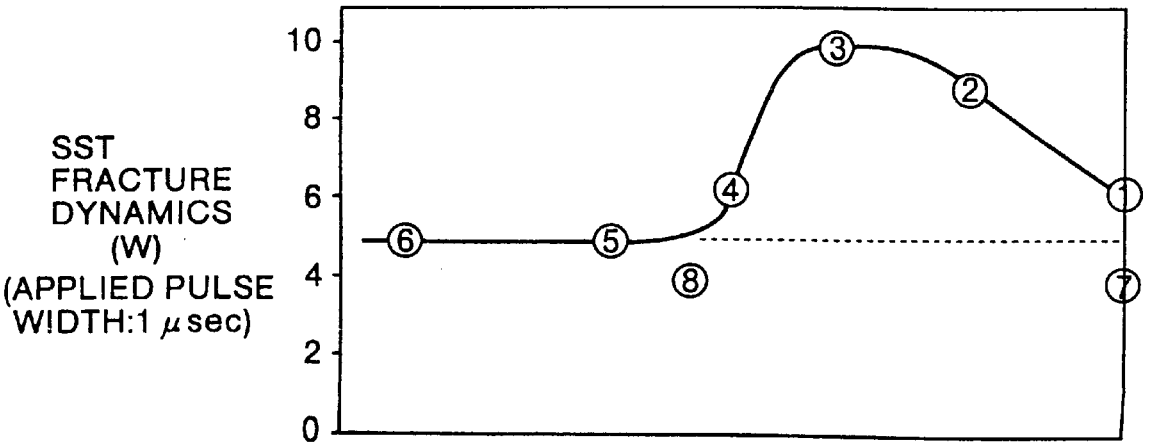
FIG. 8 is a chart indicating step stress test fracture dynamics of sample 1 to 8 when applied with pulses of voltage in water-based ink.

The results of this test performed on sample 3 are shown in FIG. 7. Nucleation boiling began when the application power was increased to about 2.7 W. As shown in FIG. 8, sample 3 endured application of power up to 10 W, which is three or four times the power required for nucleation boiling. That is to say, thermal heaters formed from the composition of sample 3 will not be damaged even when applied with abnormally large voltages during actual operation. The results of tests performed on the other samples are also included in FIG. 8. It can be seen that thermal heaters having the composition range of samples 1 to 4 show high reliability.

Next, an explanation will be provided for tests made to evaluate life of the thermal heaters under open pool boiling conditions in water-based ink. The anti-cavitation characteristic of the thermal heaters was evaluated under conditions of open pool boiling in water-based ink having a depth of 300 μm. The standard pulse application conditions were used as the pulse application conditions. It was observed by monitoring with stroboscopic photography that nucleation boiling was properly generated until directly before the thermal heaters were destroyed. In addition to yellow ink, a variety of other electrolytic inks used in commercially available ink jet devices were used in the test as the water-based ink. However, no difference in life was observed during these tests regardless of the type of ink used. No difference could be observed regardless of whether the pH of the ink was basic or acidic. Also, no difference could be observed regardless of whether the ink was a pigment type ink or a dye type ink.

Figure 9:
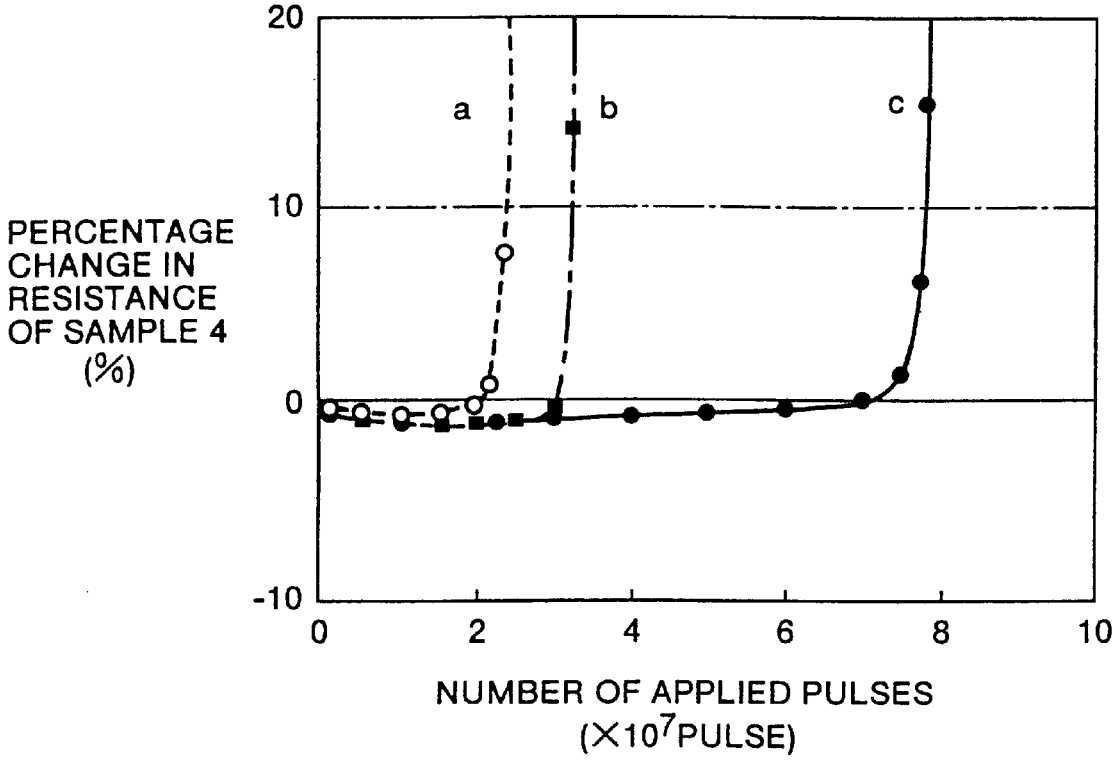
FIG. 9 is a graph representing results of life tests performed on sample 4 in water-based ink under open pool boiling conditions.

FIG. 9 shows results of life tests relating to sample 4 when tested under three different conditions. Under condition a, sample 4 was not thermally processed under standard thermal process conditions. Instead, sample 4 was processed using the standard pulse application conditions (3.0 W×1 μsec, 10 kHz) in atmosphere for 10 minutes. That is, sample 4 was only heated $6\times10_6$ times in thermal pulses estimated as having a peak temperature of around 330° C. Sample 4 when thermally processed under condition a will be referred to as sample a, hereinafter.

Under condition b, pulses of 1.2 W×100 μsec power were applied to sample 4 at a frequency of 5 kHz in atmosphere for 60 seconds. The resultant peak temperature of sample 4 was lower than the peak temperature resulting from the standard thermal process conditions. Sample 4 when thermally processed under condition b will be referred to as sample b, hereinafter.

Under condition c, sample 4 underwent thermal oxidation processes under the standard thermal process conditions.

Sample 4 when thermally processed under condition c will be referred to as sample c, hereinafter.

In this way, the anti-cavitations characteristics for thin film heaters having the same composition were evaluated by changing the thermal oxidation process temperature and, therefore, the thickness of the resultant insulating oxidation film.

Even the thermal oxidation film produced by low temperature processing, and estimated to be only at most a few 10s of Å thick, successfully endeared anti-cavitation for over ten million pulses. However, when 15 million pulses were exceeded, some cavitation damage, or pock marks, could be observed in the central portion of the thermal heater. FIG. 9 shows that the thicker insulating oxidation films of samples b and c have greater anti-cavitations characteristic than that of sample a. However, even the thickest oxidation film of sample c is only about 100 Å thick.

Figure 10:
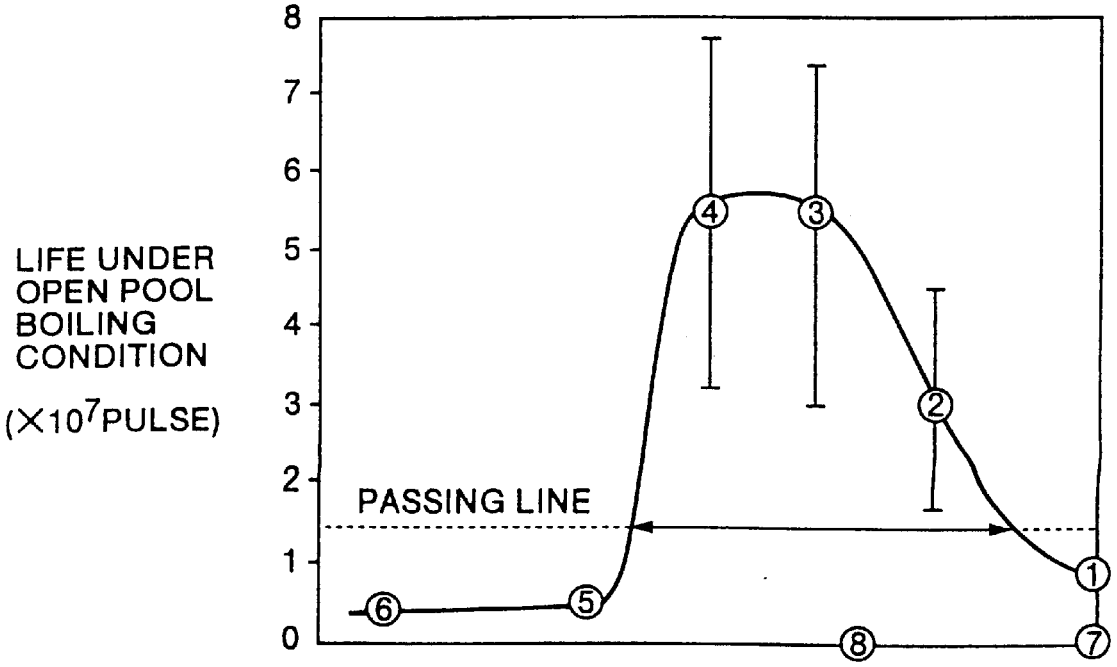
FIG. 10 is a chart indicating results of life tests performed on samples 1 to 8 in water-based ink under open pool boiling conditions.

It is well-known that even in the same lot of samples having the same composition, some variation in life can be observed under open pool boiling conditions because of fluctuation in collapse of the vapor bubbles. The data for sample c shown in FIG. 9 also has some variation. The average life including this variation is shown in FIG. 10. Life of samples 2, 3, and 4 was determined according to when the heater surface was destroyed by cavitation. However, it is assumed that in the case of samples 1, 5, and 6 (and also 7 and 8), the thermal heaters broke near the conductive film and so their life was not determined by destruction of the heater surface by cavitation.

Next, an explanation will be provided for tests performed to evaluate life of actual print heads using the sample thermal heaters described above.

A top-shooter-type print head having 70 μm pitch and 360 dpi for printing was produced using a sample 3 thermal heater. Ink was consecutively ejected 100 million times under the standard pulse application conditions to eject water-based ink. However, no change could be observed in ejection of ink. The method of producing the heads is the same as described above.

After the life tests were performed, the sample 3 thermal heater was removed from the printer head and the surface was observed in detail. No abnormality could be observed. That is to say, although cavitation pock marks could be observed using an optical microscope after applying only 30 to 40 million pulses in an open pool boiling situation in 300 μm deep water, absolutely no pock marks could be observed in the practical head even after application of 100 million pulses. As already pointed out by L. S.Chang et al on page 241 of *Proceedings of the 9th International Congress On Advancements In Non-Impact Printing Technology* from Japan Hardcopy'93, held in Yokohama in 1993, during a closed pool boiling situation, such as in a practical head, the contraction of vapor bubble is regulated by the surrounding walls so that the destructive force of cavitation is greatly reduced and the life of the thermal heater can be increased.

To further confirm this, the same tests were performed in a head using a conventional printer. The printer was the newest model available in 1995. Both top-shooter side-shooter type heads were used to eject 100 million ink droplets each. However, no cavitation pock marks on the surface of the thermal heaters used therein could be observed with an optical microscope. Then the thermal heaters were removed from both these heads and their lives evaluated in an open pool situation of 300 μm deep water. The thermal heater from the side-shooter type print head was destroyed after application of between 15 to 30 million pulses. The thermal resister from the top-shooter type print head was destroyed after application of 15 to 70 million pulses. In both cases, cavitation pock marks were visible after application of between 10 to 15 million pulses.

Therefore, as shown in FIG. 10, the passing line for open pool boiling life was set at 15 million pulses. Therefore, thermal head having a composition in the range indicated by the arrows will pass the open pool boiling life test. This composition range includes sample 2, 3, and 4. From the above-described results, it can be determined that thermal heaters with composition in the range indicated by the hexagon in FIG. 1 have a life of 100 million pulses or more when used to eject ink droplets in an actual print head. As mentioned above, the range includes atomic percentages (a/o) of 64%≦Ta≦85%, 5%≦Si≦26%, 6%≦O≦15%. Atomic percent is the number of atoms of an element in 100 atoms representative of a substance such as an alloy.

Figure 11:
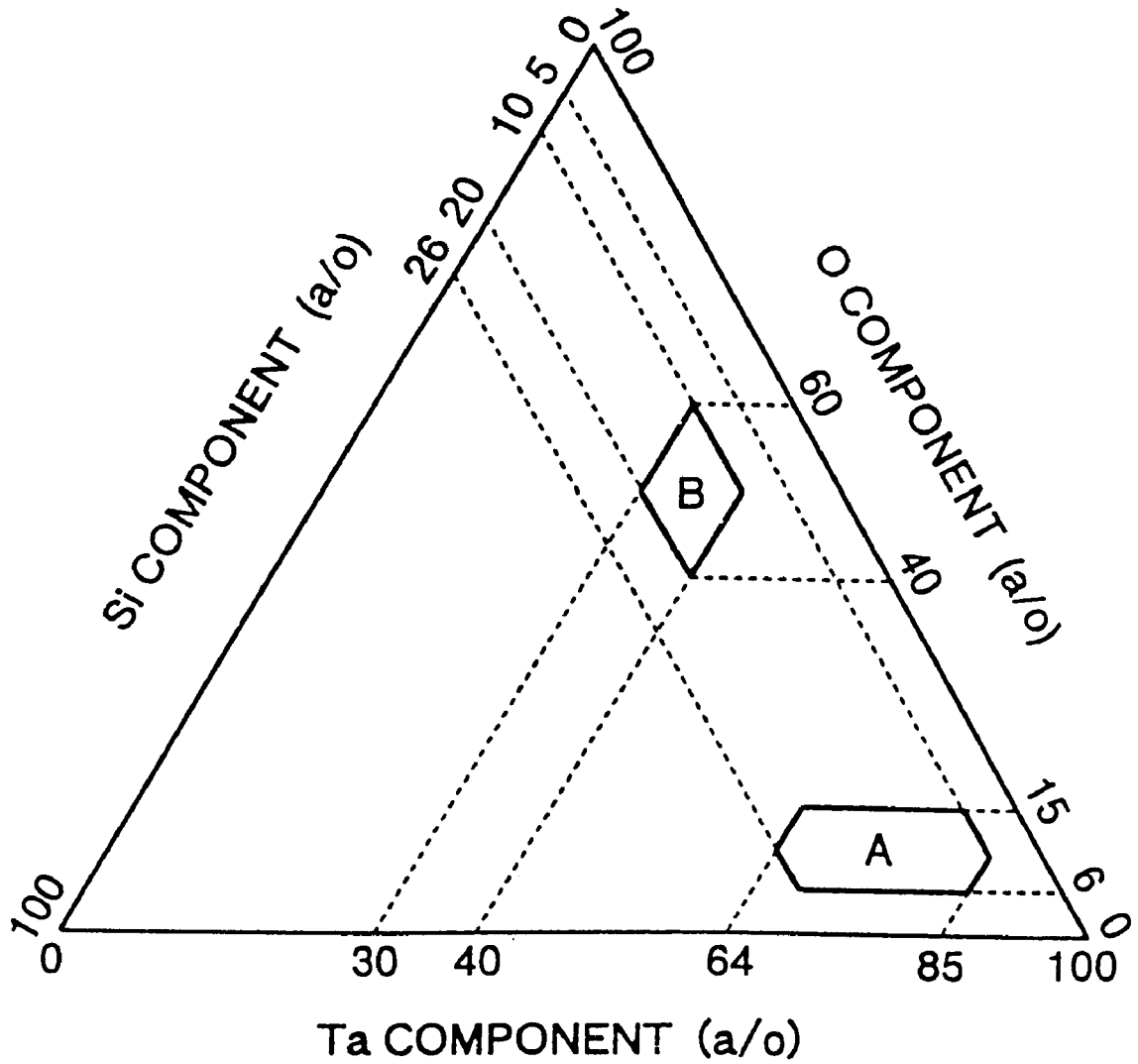
FIG. 11 is a graph representing range of composition of conventional Ta—Si—O ternary alloys used in a thermal printer and of Ta—Si—O ternary alloys according to the present invention.
Figure 12:
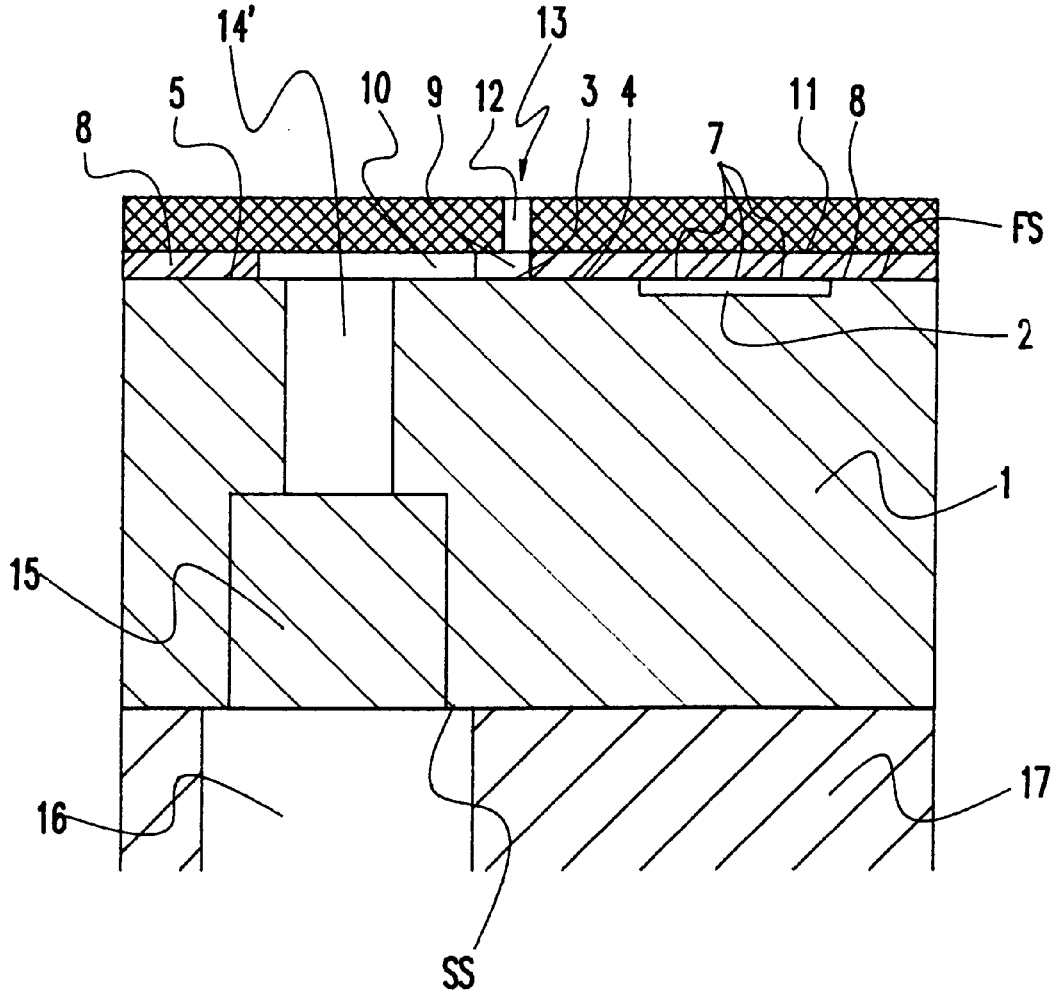
FIG. 12 is an ink chamber and nozzle of the present invention.
Figure 13:
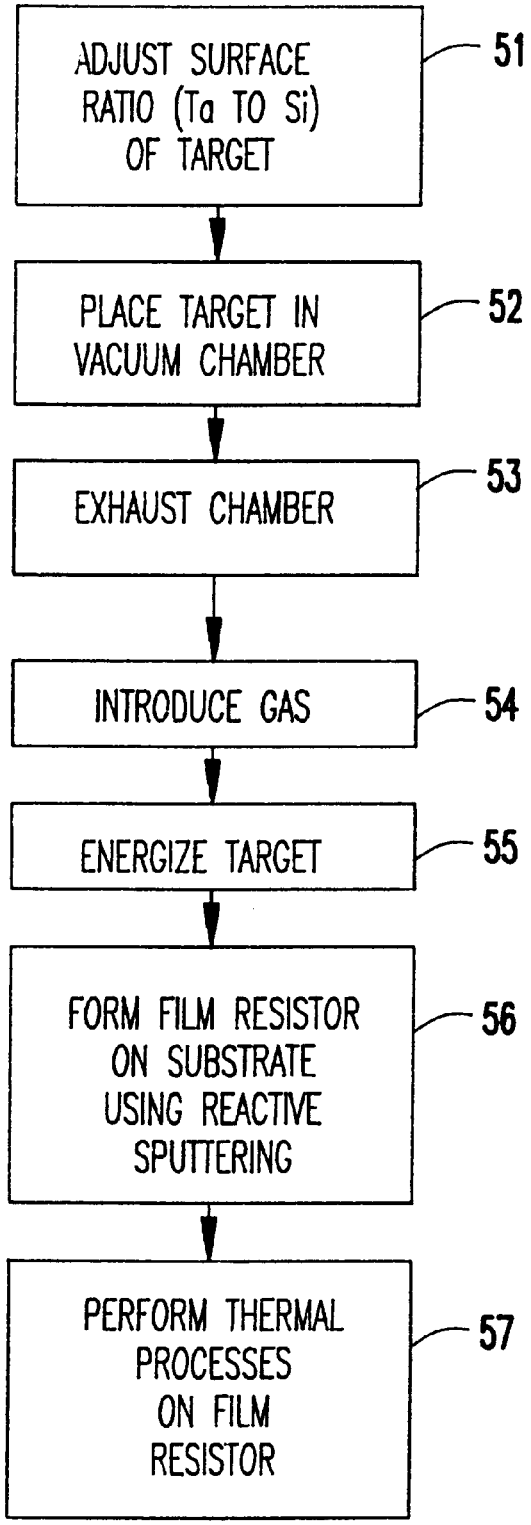
FIG. 13 is a process of forming the alloy thin film resistor.

Range A in FIG. 11 indicates the range of composition for a Ta—Si—O ternary alloy thin film heater according the present invention. Range B of FIG. 11 indicates the range of composition for a thermal head according to OPI No. SHO-62-167056. The reason for the unexpected difference in composition range is because the thermal heater described in OPI No. SHO-62-167056 is covered with an anti-abrasion protective layer. However, no such protective layer is used in the thermal heaters of the present invention. Therefore, electrolytic ink comes in direct contact with the thermal heaters of the present invention. Reliability of the thermal heaters of the present invention must be greatly enhanced with respect to damage by cavitation to prevent related possible problems.

Next, an explanation will be provided for thermal efficiency and heating/cooling characteristics of the thermal heaters. The thermal heaters according to the present invention can induce nucleation boiling from application of a 2.7 W/50 $\mu m^2$ print power in 1 μsec long pulses. To provide leeway, the standard pulse application condition is set at 3.0 W×1 μsec. On the other hand, thermal heaters formed with protective layers require application of 5.0 W×3.5 μsec for a 50 $\mu m^2$ heater, or 5 or 6 times as much energy. The energy required to eject ink droplets is known to be only about 1/100 to 1/1000 of these values. Almost all energy applied is consumed for heating the substrate. Therefore, the substrate must be able to cool rapidly and efficiently. Therefore, the present invention not only lowers power consumption of the thermal heaters but also removes the need to greatly cool the substrate.

Regardless of the type of the thermal heater, its surface needs to reach a temperature of 300° C. The rising temperature speed of the thermal heater according to the present invention is 300° C./1 μsec, or $3\times10^{8}$° C./sec. On the other hand, the rising temperature speed of thermal heaters having thick protective layers is reduced by an amount corresponding to the thickness of the protective layers, that is, from approximately 300° C./3.5 μsec, or $0.86\times10^{8}$° C./sec, to about $0.7\times10^{8}$° C./sec. A large amount of power needs to be applied to thermal heaters with protective layers in order to increase their rising temperature speed and thereby enable shortening the pulse width. However, to achieve this, a voltage and current too large for practical use must be applied to the thermal heaters. Furthermore, if the applied voltage becomes too large, the performance of the IC or LSI for applying the voltage will be exceeded. For these reason, the maximum heating speed achievable by conventional thermal heaters having thick protective coverings is about $0.7\times10^{8}$° C./sec.

On the other hand, because the thermal heaters of the present invention contact the ink direction, they need be energized using only a short pulse of low voltage so that a rising temperature speed of $1\times10^{9}$ ° C./sec becomes practical. Because the ink ejection characteristics improve with the speed or the temperature speed of the thermal heater, the thermal heaters according to the present invention can be used to eject ink droplets with good ejection characteristics.

The speed at which the surface of the thermal heater cools increases by more than an inverse proportion to its distance from the silicon substrate, which serves as a heat sink. The thermal heaters according to the present invention cool at speeds several times faster than conventional thermal heaters which have thick protective layers that serve as thermal barriers. Also, ink refilling the ink chamber after ejection can be reheated more stably.

The thermal heaters according to the present invention directly reduce production costs by eliminating the need for protective layers.

The thermal heater according to the present invention is unaffected by galvanization even when used in an electrolytic non-neutral water-based ink and can endure ejecting 100 million or more ink droplets by being applied with 100 millions or more pulses of voltage. The oxidized film formed on the surface of the thermal heater is extremely thin, only several 10 Å thick, and has the same or greater anti-cavitation characteristics of thicker 3 to 4 μm thick protective layers of conventional thermal heaters. The thermal heater of the present invention has good anti-pulse characteristics and anti-oxidation characteristics. Added to this are the good anti-galvanization characteristics and anti-cavitation characteristics of the self-formed extremely thin oxidation layer. The application energy required to eject ink droplets can be reduced to 1/5 to 1/10 of values needed for conventional thermal heaters. Extremely rapid heating required to quickly and stably eject ink droplets can be achieved by the thermal heater of the present invention.

According to the present invention, no protective layers need to be formed on the thermal heater so that the production cost of the thermal heater can be greatly reduced. Also, thermal efficiency is increased by 5 or 6 times. Cooling burden of the ink jet device is reduced to 1/5 or 1/6 of conventional requirements. Further, the ink heating speed can be increased 5 or 6 times and the cooling speed of the thermal heaters can be increased 2 to 3 times so that ink ejection characteristic can be improved.

What is claimed is:

1. An ink jet printing device comprising:

an ink channel wall defining an ink chamber;

a nozzle portion formed with a nozzle connecting the ink chamber with atmosphere;

a thermal heater formed to the ink channel wall adjacent to the nozzle portion, the thermal heater including:

a Ta—Si—O ternary alloy thin film resistor having a composition of 64%≦Ta≦85%, 5%≦Si≦26%, and 6%≦O≦15% in atomic percents; and a nickel film conductor, wherein the thermal heater is used with the thin film resistor in direct contact with ink to be ejected.

2. An ink jet printing device as claimed in claim 1, wherein the Ta—Si—O ternary alloy thin film resistor is formed by a reactive sputtering technique using a target of Ta and Si.

3. An ink jet printing device as claimed in claim 2, wherein the Ta—Si—O ternary alloy thin film resister is thermally processed in an oxidizing atmosphere by energizing the resistor in pulses so that a surface of the Ta—Si—O ternary alloy thin film resister reaches a peak temperature of at least 330 degrees C. with each pulse.

4. An ink jet printing device as claimed in claim 1, wherein the Ta—Si—O ternary alloy thin film resister is thermally processed in an oxidizing atmosphere by energizing the resistor in pulses so that a surface of the Ta—Si—O ternary alloy thin film resister reaches a peak temperature of at least 330 degrees C. with each pulse.

5. An ink jet printing device as claimed in claim 1, wherein the Ta—Si—O ternary alloy thin film resister is formed on a substrate; and further comprising a drive circuit for driving the resister and formed on the substrate.

6. An ink jet printing device as claimed in claim 1, further comprising a heat resistance wall covering the nickel film conductor.

* * * * *